US007156247B2

(12) United States Patent
Laburu

(10) Patent No.: US 7,156,247 B2
(45) Date of Patent: Jan. 2, 2007

(54) STOPPER WITH GUARANTEED TAMPER-PROOF SEAL

(75) Inventor: Alberto Ochoa Laburu, Guipuzcoa (ES)

(73) Assignee: Betapack, S.A., Irun (ES)

( * ) Notice: Subject to any disclaimer, the term of this patent is extended or adjusted under 35 U.S.C. 154(b) by 0 days.

(21) Appl. No.: 10/819,852

(22) Filed: Apr. 6, 2004

(65) Prior Publication Data

US 2004/0188374 A1 Sep. 30, 2004

Related U.S. Application Data

(63) Continuation of application No. PCT/ES02/00425, filed on Sep. 10, 2002.

(51) Int. Cl.
*B65D 43/16* (2006.01)
*B65D 41/34* (2006.01)
*B65D 47/10* (2006.01)

(52) U.S. Cl. ..... 215/235; 215/253; 215/254; 222/541.6

(58) Field of Classification Search ..... 215/250–254, 215/295, 302, 235, 237, 387, 273; 220/266, 220/255, 256.1, 257.1, 259.1, 836, 717, 315; 222/556, 153.05, 153.06, 153.07, 153.14, 222/256.1, 257.1, 259.1, 836, 717, 315, 541.5, 222/541.6

See application file for complete search history.

(56) References Cited

U.S. PATENT DOCUMENTS 3,926,327 A * 12/1975 Schickedanz ..... 215/218
5,397,009 A 3/1995 Salmon et al.
2004/0178166 A1* 9/2004 Antier et al. ..... 215/235

FOREIGN PATENT DOCUMENTS

| | | | | |
|---|---|---|---|---|
| CH | 683335 A5 | | 2/1994 | |
| EP | 644125 A1 | | 3/1995 | |
| EP | 703155 A1 | | 3/1996 | |
| EP | 899204 A1 | | 3/1999 | |
| WO | WO 91/13813 | * | 9/1991 | ..... 215/235 |
| WO | WO 93/00271 | * | 1/1993 | ..... 222/556 |
| WO | WO 9514617 A1 | | 6/1995 | |
| WO | WO 02/36454 | | 5/2002 | |

* cited by examiner

*Primary Examiner*—Robin A. Hylton
(74) *Attorney, Agent, or Firm*—Katten Muchin Rosenman LLP

(57) ABSTRACT

A stopper incorporates a cylindrical body attachable to the edge of a container or bottle and a cover with a hinge. In the upper part of the body is incorporated a mouthpiece blockable by means of a neck of the cover. On the body of the stopper is a sealing strip joined by breakable points, wherein in-cuts are established for the retaining of corresponding projections in the cover in its closed position. The strip is provided with end wings that are positioned in depressions of the side surface of the cover, without projecting from this, the positioning of a shield of the cover in a depression of the upper edge of the sealing strip, as well as a number of vertical ribbings of the strip and the mouthpiece that are out of line with respect of the center of the stopper, with a displacement towards the sealing strip area.

9 Claims, 4 Drawing Sheets

A-B

STOPPER WITH GUARANTEED TAMPER-PROOF SEAL

CROSS REFERENCE TO RELATED APPLICATIONS

This is a continuation of International Application PCT/ES2002/00425, filed on Sep. 10, 2002.

FIELD OF THE INVENTION

The present invention refers to an tamper-proof stopper that incorporates a mouthpiece through which the liquid contents of the bottle, in which the stopper is applied, can be consumed; this being supplemented with a cover made integral with the stopper body through a tight hinge, and in which cover suitable means have been arranged so that in the closed position they block the mouthpiece.

The object of the invention is to provide a stopper of the above-mentioned type, that incorporates means for making the stopper tamper-proof, that are formed by means of a sealing strip that assists with special means provided in the actual stopper, and that rapidly break when fraudulent handling of it occurs.

BACKGROUND TO THE INVENTION

A great number of stoppers for bottles exist that incorporate a mouthpiece that allows drinking directly through the stopper, so that the body of this latter has appropriate means for it to be attached onto the neck of the bottle, it being supplemented by the hinging of a cover that can occupy a closed position or a fully open position, without forming an obstacle so that a person may directly drink the liquid contained in the bottle, through the corresponding mouthpiece.

In this respect can be mentioned the PCT ES00/00417 of same applicant, in which a stopper for bottles with a built-in mouthpiece is described, that among other characteristics presents the particularity that the mouthpiece is off-centre with respect to the geometric centre of the surface of the stopper in which it is placed, to allow the consumption or direct drinking of the contents of the bottle to be carried out with greater ease and convenience.

Likewise, in that PCT means for sealing the stopper are described, formed by laminas suitably secured both in the mouthpiece outlet and in the neck of the cover, and that, in the closing of this latter, join together over said mouthpiece, but that in no case, are intended to prevent the fraudulent opening of the bottle.

On the other hand, stoppers of the above-mentioned type are known in which the cover and the body of the stopper include a sealing element formed by means of interlocking provided in the cover and body of the stopper, and that interlock with each other, but that can be breached by deformation or pushing of one piece with respect to the other, which is possible due to the deformability of the material of which these types of stopper are fabricated, which is usually plastic.

SUMMARY OF THE INVENTION

The stopper that is proposed pertains to the type that incorporates a mouthpiece for the direct consumption of the contents of the bottle in which the stopper is placed, as well as a cover hinged to the body of the stopper that, in the closed position, blocks the mouthpiece, so that based on these characteristics the innovation of the invention centres fundamentally on the incorporation of a special seal formed by a sealing strip integrated through frangible points on the upper edge of the stopper body, in correspondence with a sector of this latter.

The sealing strip has in-cuts in his lower edge, in which twin projections from the cover lodge and remain anchored, when this latter is in the closed position; projections that are logically made at points of the surround near to the edge of the cover, in order that, in the closing of this latter over the top part of the stopper body, these projections are lodged in the in-cuts, and therefore the interlocking of the cover with respect to the seal that the aforementioned strip forms is produced, bearing in mind that this is joined the stopper body through frangible points, that will break if a fraudulent opening of the stopper is attempted, making evident the handling carried-out. Of course, the projections of the cover are tight against the lower in-cuts of the sealing strip, so that there is not sufficient looseness for unlawful handling.

To carry out the opening of the bottle it is necessary to break the sealing strip, this having two end wings that fit in depressions established for this purpose in the side surface of the cover, forming a surface continuity between the sealing strip and the side surface of that cover body, without any part projecting, it being sufficient to introduce a fingernail along the depressions of the cover surfaces and to be able to release outwards the end wings of the sealing strip, to stretch and to bring about the rupture of the frangible points of this sealing strip and with this its ripping, allowing the cover to open.

Furthermore, two lower in-cuts made in the sealing strip ensure that this latter is divided and joined to the stopper body at three parts or sections, in such a way that the sealing strip becomes less elastic, thus avoiding that side pressure on the stopper could produce the release of the cover projections.

Specifically, if we stretch the seal from one of the ends to try to free the projections, we will be tightening the other end of the seal, because of which the points of connection of the seal with the stopper body at that end will break making evident the unlawful handling.

The stopper referred to has, furthermore, the particularity that the mouthpiece for pouring or for consumption is out-of-line with respect to the geometric centre of the upper surface of the stopper body, which, on one hand, facilitates direct consumption and implies greater convenience for the consumer, but principally it prevents the area of the cover that is facing this mouthpiece from being able to move inwards by deformation, in an attempt to effect the releasing of the projections of said cover with respect of the in-cuts established in the lower part of the sealing strip.

A shield arranged in the side surface of the cover, specifically between the in-cuts in which the side wings of the sealing strip are positioned, assists in that tamper-proofing; a shield that is placed on top of a wide depression corresponding to the upper edge of this sealing strip, and that avoids the introduction of any utensil from the upper part of the seal to flex or bend the seal forward, and with that the release of the cover projections.

The stopper also incorporates a series of vertical ribbings placed along the seal and in vertical walls provided in the depressions for the positioning of the end wings of the strip, the vertical ribbings of the strip and stopper being alternatively placed so that they prevent the introduction of any utensil or sharp-pointed item, such as could be a wire or pin, intended to release the projection, through the hollow existing between the wings of the strip and the corresponding depression of the stopper. Obviously, if we try to introduce a utensil through the end of the strip, it will collide with some of the vertical ribbings and therefore, it will not be possible to carry out the operation.

These vertical ribbings are precisely the connecting elements between the strip and the stopper body, in such a way that, on attempting to breach the seal through its upper part, we are forcing the connection points that will immediately break with incorrect use.

Independently of the structural, functional and improvement characteristics that the aforementioned stopper implies, this one has the particularity of offering an optimum aesthetic appearance, by presenting a cover in the shape of truncated helmet, and where the sealing strip forms a surface continuity with the side surface of the actual cover.

Finally, to state that the stopper assembly, including the cover and of course the seal, can be obtained by injection in the mould.

BRIEF DESCRIPTION OF THE DRAWINGS

To supplement the description that is being carried out and with the aim of leading to a better understanding of the characteristics of the invention, in accordance with a preferable example of its embodiment, as an integral part of said description it is accompanied by a set of drawings, in whose figures, in an illustrative and non-limiting way, the following have been represented:

FIG. 4.—Shows a perspective view of the stopper in the closed position but without the sealing strip, leaving visible the vertical ribbings provided in the cover in the areas corresponding to that of the positioning of the sealing strip referred to.

PREFERABLE EMBODIMENT OF THE INVENTION

Figure 1:
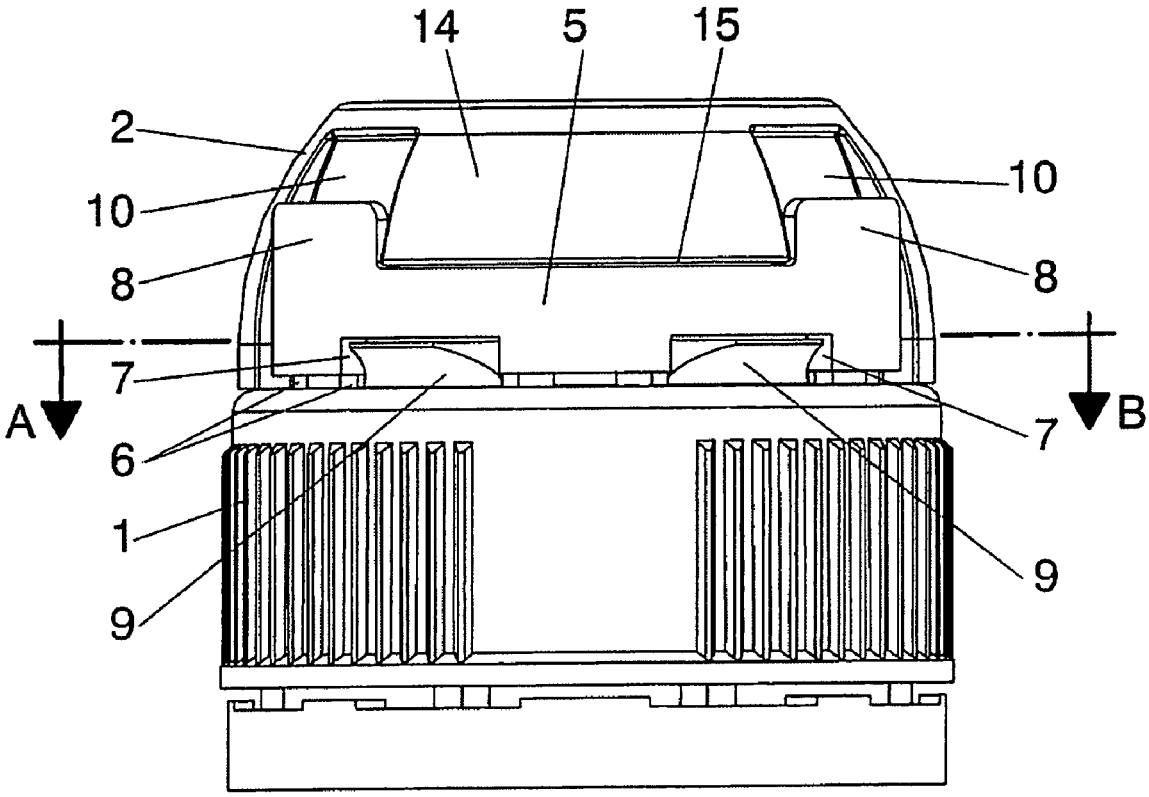
FIG. 1.—Shows an elevation representation of the stopper of the invention with its sealing strip and the cover.
Figure 2:
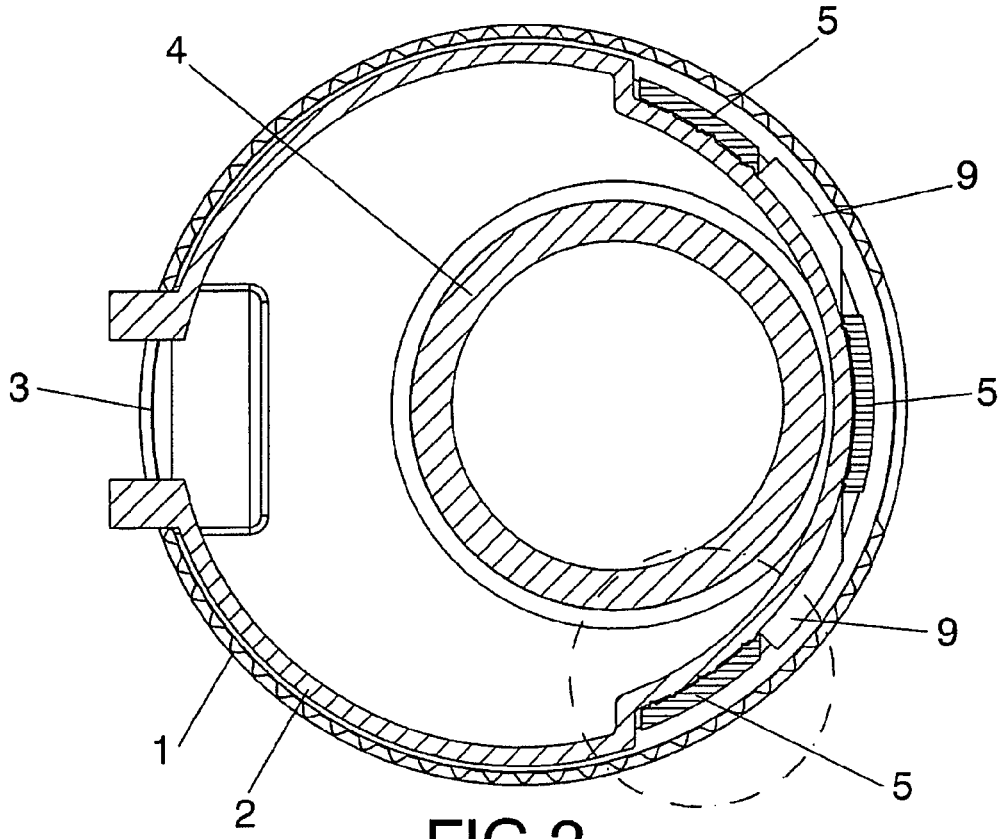
FIG. 2.—Shows a section view of the stopper of the invention, corresponding to the section line A–B of the previous figure, with the cover in the closed position and the sealing strip performing its function, that is, preventing the opening of said cover.
Figure 3:
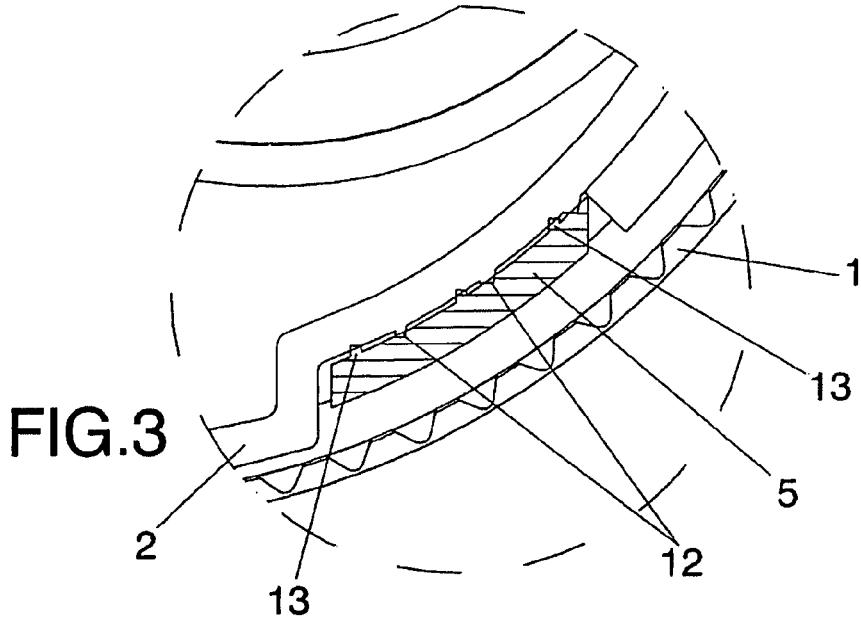
FIG. 3.—Shows an extended view of the detail corresponding to the meshing between the teeth provided in the sealing strip and in the cover.
Figure 4:
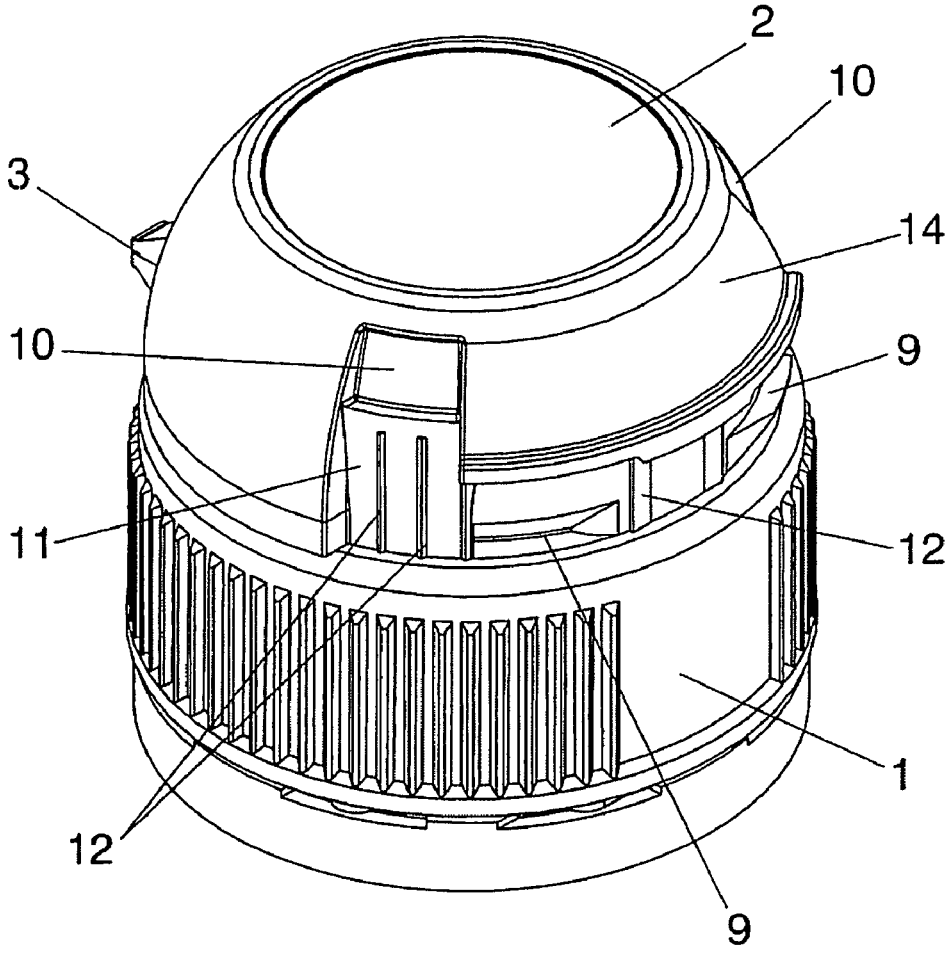
Figure 5:
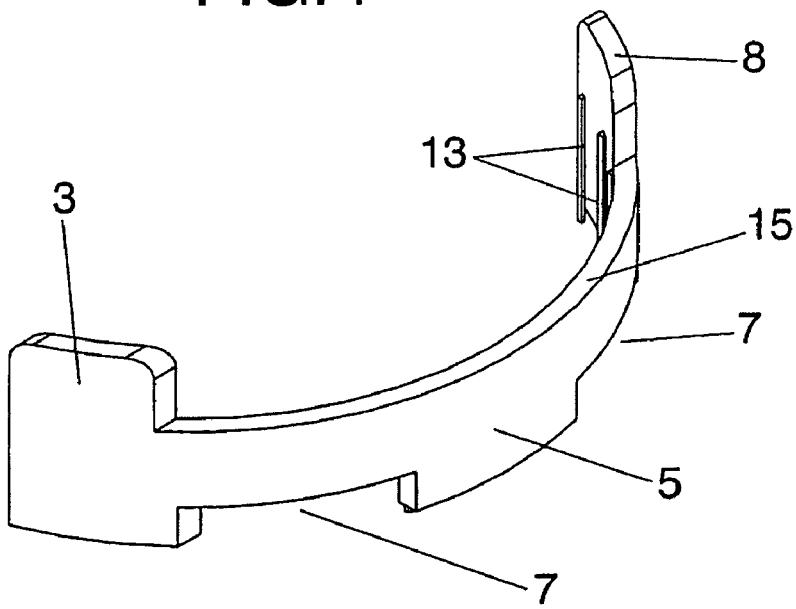
FIG. 5.—Shows a front perspective view of the sealing strip.
Figure 6:
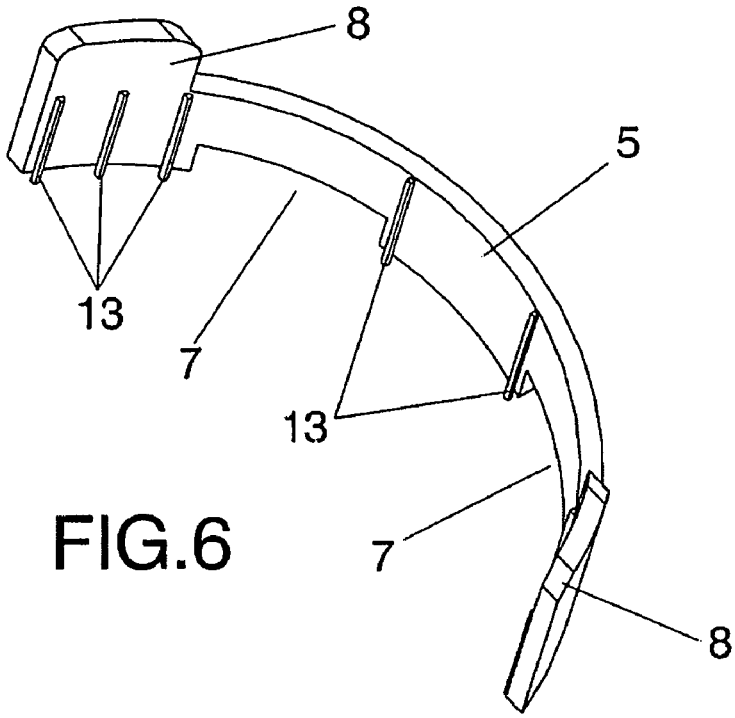
FIG. 6.—Shows another perspective view, in this case of the internal part of the sealing strip, allowing its vertical ribbings to be seen.
Figure 7:
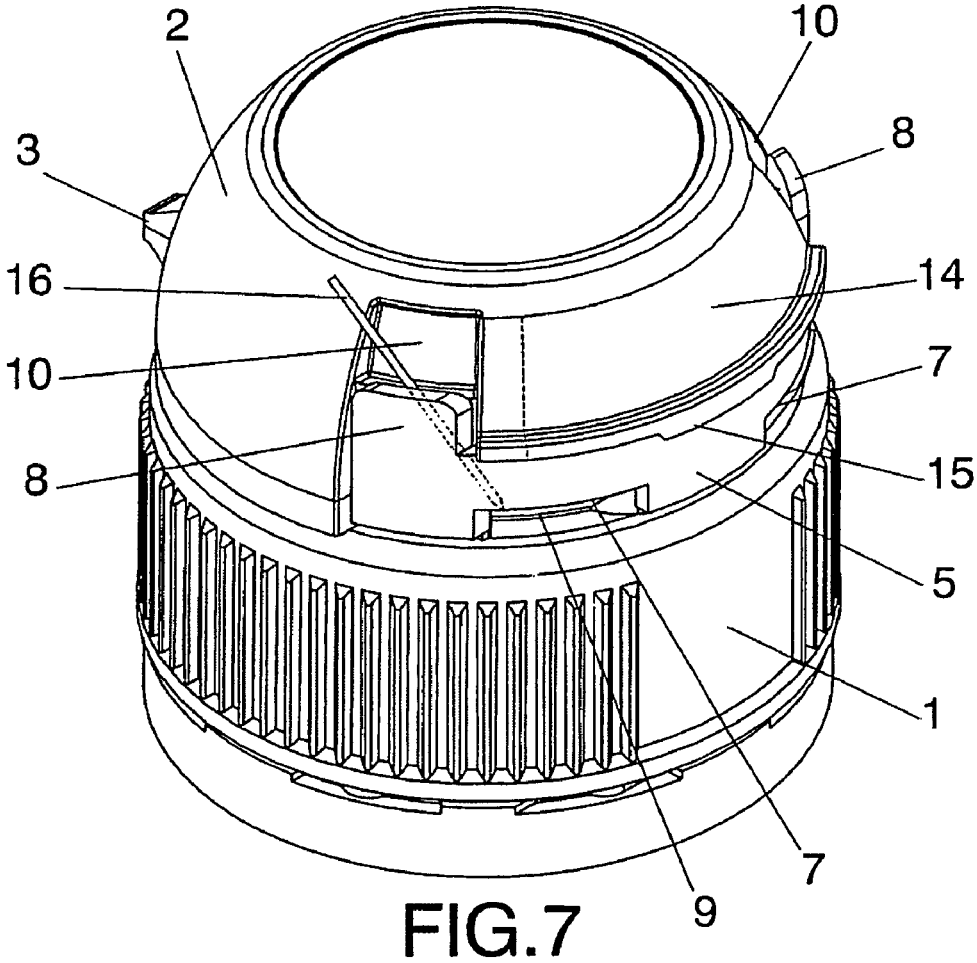
FIG. 7.—Shows, finally, a perspective view of the impossibility of producing a fraudulent manipulation with opening of the seal, without resulting in its tearing.

As can be seen in the figures, the stopper, object of the invention, is constituted based on a cylindrical column (1), internally fitted with the corresponding means of attaching onto the neck of the bottle, said body or stopper (1) being supplemented with a cover (2) integral with it by means of a bistable system of hinging (3), that is, that from an intermediate opening position of said cover (2), it tends to occupy either a closed position or an open position.

In the top surface of the stopper the pouring mouthpiece (4) has been provided, that is out-of-line with respect to the centre, through which mouthpiece not only the pouring of the contents of the bottle in which the stopper is applied can be carried out, but also the direct consumption by any person, this mouthpiece (4) being blocked in the closed position of the cover (2) by means of a neck which for this purpose said cover has in his interior.

The body of the stopper (1) incorporates a seal formed by a strip (5) integral with the upper surface of the body (1) and near to its external edge, through frangible points (6), so that if said strip (5) is stretched, the frangible points (6) break, producing the unsealing of the cover (2), which it will be possible to open by swivelling.

This sealing strip (5) has a pair of lower in-cuts (7), whereas its ends terminate in twin wings (8) that will form the means of gripping and stretching to bring about the corresponding tearing or unsealing. The in-cuts (7) are provided in the lower edge of the strip (5), while the wings (8) are in the upper edge.

For its part, the cover (2) has in sections of the side surface and near its edge, a pair of projections (9) that when in the position of closing onto the body of the stopper (1) they become lodged and remain held in the in-cuts (7) previously referred to, preventing the opening of such cover (2) unless the sealing strip (5) is torn.

The end wings (8) of the sealing strip (5) stay positioned in twin depressions (10) provided for this purpose in the side surface of the cover (2), these depressions (10) having a vertical wall (11) with vertical ribbings (12) furthermore it being arranged that in the section of cover (2) formed between said two depressions (10) two other vertical ribbings similarly referenced with the number (12) exist.

For its part, the sealing strip (5) incorporates both in the internal face of the end wings (8) and in an intermediate area of it, ribbings (13) that in addition to constituting the connection ties or frangible points, (6) form means that mesh with the ribbings (12) of the side surface of the cover (2) that assist in the tamper-proofing of the actual seal that is being described, as hereinafter will be expounded.

Tamper-proofing is assured as a consequence of the fact that the cover (2) cannot be deformed by pressing inwards, in an attempt of to free the projections (9) from the in-cuts (7), since the attempt of inwards deformability is impeded by the off-centre position of the mouthpiece (4). Furthermore, neither can the sealing strip (5) be deformed, because of the fact that a shield (14) has been provided on the side surface (2) of the cover, that remains positioned in correspondence with a depression (15), i.e. second in-cut, established for this purpose in the top edge of the sealing strip (5), the shield (14) forming a surface continuity with said sealing strip (5) that prevents the manipulation of the said strip (5).

It should be emphasized that that the wings (8) for stretching in order to tear the seal, remain in their rest position, held without projecting from the depressions (10) provided in the side surface of the cover (2), specifically at both sides of the above-mentioned (14) shield.

The in-cuts (7) are formed with a notable distancing between each other, in order to impede the egress of both projections (9) from said in-cuts (7) when it is tried to deform the cover or manipulate the actual sealing strip (5).

By including two in-cuts (7) and defining three sectors in the seal (5), it will be achieved that said seal has less elasticity, because of which it will be more difficult to press and to force it in a violent attempt at opening.

Likewise, if the seal (5) is stretched from one of the ends, to try to unblock it, the opposite end will be tightened, with which the attachment point or frangible points (6) of the seal (5) with the body (1) will fracture, making evident possible unlawful handling.

The tamper-proofing is complemented by the fact that the pouring mouthpiece (4) is out-of-line with the centre, that is, displaced towards the actual seal (5), which will form a limit stop for it in the moment in which it is pushed backwards.

The previously mentioned shield (14), provided in the cover (2), also assists in the tamper-proofing, so that this shield, by covering the straight area of the seal (5), prevents it being possible to introduce any element from the top part to bend the seal forward.

Furthermore, the cross-linking or joining of the ribbings (12) and (13) corresponding to the cover (2) and to the sealing strip (5), on trying to introduce some thin element at an angle, such as a needle, wire or similar, as is shown in figure (8), it is impossible to carry it out because of the aforementioned ribbings in the shield (14) position, and of the combination of the above-mentioned elements, since in the moment that it is wished to force and displace the sealing strip (5) outwards, the frangible points (6) immediately break due to the fact that this strip sealing (5) is joined, through these frangible points (6), effectively to the body of the stopper (1).

I claim:

1. A stopper for a container, the stopper comprising:

a cylindrical stopper body attachable to the container;

a mouthpiece in the stopper body for passing a content of the container;

a cover hinged to the body, the cover comprising a projection and a shield;

a removable sealing strip for preventing opening of the cover without removing the sealing strip, the sealing strip having a first in-cut in a lower portion of the strip and a second in-cut at an upper portion of the strip, the projection being restrained in the first in-cut, the shield being restrained by the second in-cut;

a first plurality of ribbbings disposed on the sealing strip and connecting the sealing strip to the cover.

2. The stopper of claim 1, wherein the cover comprises at each side of the shield a depression, the sealing strip comprising at each end a wing, and the wings being disposed to each side of the shield within the depression.

3. The stopper of claim 2, wherein each of the depressions comprises a vertical wall, each of the vertical walls comprising a second plurality of vertical ribbings, at least one ribbing of the first plurality of ribbings being disposed on each of the wings, the at least one ribbing of the first plurality of ribbings disposed on each of the wings being joined to a respective one of the second plurality of ribbings to assist in tamper-proofing.

4. The stopper of claim 3, wherein the first plurality of ribbings further is connected to the stopper body, the first plurality of ribbings forming frangible points with the stopper body for breaking when the sealing strip is displaced.

5. The stopper of claim 1, further comprising a lid for sealing the mouthpiece, wherein the mouthpiece is disposed off-center relative to a center of an upper surface of the stopper body towards the sealing strip, the mouthpiece being disposed off-center to prevent deformation of the stopper by pushing the cover to free the projection from the first and second in-cuts.

6. The stopper of claim 1, wherein the sealing strip comprising at each end a wing having a flat surface, the wings being disposed to each side of the shield.

7. The stopper of claim 1, wherein the sealing strip comprises a further lower in-cut and the cover comprises a further projection, the further projection being restrained by the further in-cut.

8. The stopper of claim 7, wherein the upper in-cut is centered between the lower in-cuts.

9. The stopper of claim 1, wherein the shield comprises a size to cover a portion of the sealing strip to prevent prying.

* * * * *